US008551266B2

(12) United States Patent
Imamovic et al.

(10) Patent No.: US 8,551,266 B2
(45) Date of Patent: Oct. 8, 2013

(54) METHOD, ALLOY AND COMPONENT

(75) Inventors: Dzevad Imamovic, Trollhättan (SE); Göran Sjöberg, Trollhättan (SE)

(73) Assignee: Volvo Aero Corporation, Trollhättan (SE)

( * ) Notice: Subject to any disclaimer, the term of this patent is extended or adjusted under 35 U.S.C. 154(b) by 465 days.

(21) Appl. No.: 12/738,004

(22) PCT Filed: Oct. 25, 2007

(86) PCT No.: PCT/SE2007/000945

§ 371 (c)(1),
(2), (4) Date: Apr. 14, 2010

(87) PCT Pub. No.: WO2009/054756

PCT Pub. Date: Apr. 30, 2009

(65) Prior Publication Data

US 2011/0308674 A1 Dec. 22, 2011

(51) Int. Cl.
*C22F 1/10* (2006.01)
*C22C 19/03* (2006.01)

(52) U.S. Cl.
USPC ..... 148/675; 148/428; 148/426

(58) Field of Classification Search
USPC ..... 148/675, 677, 426, 428
See application file for complete search history.

(56) References Cited

U.S. PATENT DOCUMENTS

| | | | | |
|---|---|---|---|---|
| 4,795,507 | A | 1/1989 | Nazmy | |
| 5,527,403 | A * | 6/1996 | Schirra et al. | 148/675 |
| 5,759,305 | A * | 6/1998 | Benz et al. | 148/514 |
| 2005/0072500 | A1 | 4/2005 | Cao et al. | |

FOREIGN PATENT DOCUMENTS

| | | |
|---|---|---|
| EP | 0402168 A1 | 12/1990 |
| GB | 2307483 A | 5/1997 |

OTHER PUBLICATIONS

International Search Report for corresponding International Application PCT/SE2007/000945.

* cited by examiner

*Primary Examiner* — Jessee Roe
(74) *Attorney, Agent, or Firm* — WRB-IP LLP

(57) ABSTRACT

A method for heat treating a nickel base alloy includes the steps of: a. heating a nickel base alloy to at least its delta (δ) phase solvus temperature, and lower than its incipient melting temperature for a predetermined time sufficient to dissolve substantially all of the nickel base alloy's delta (δ) phase, and b. cooling the nickel base alloy to a temperature below the gamma prime (υ) precipitation temperature at a rate sufficient to precipitate the alloy's chromium carbide and gamma prime (υ) in a serrated grain boundary.

15 Claims, 3 Drawing Sheets

METHOD, ALLOY AND COMPONENT

BACKGROUND AND SUMMARY

The present invention concerns a method for heat treating a nickel base alloy. The present invention also concerns a nickel base alloy and a component comprising the nickel base alloy.

It should be noted that the expression "nickel base alloy", as used throughout this document, is intended to mean any alloy whose main constituent is nickel and the expression includes nickel base superalloys or high performance alloys.

Nickel base alloys are used in industry because of their ability to withstand a variety of severe operating conditions involving corrosive environments, high temperatures, high stresses, and combinations thereof. The mechanical properties of a nickel base alloy are closely related to the microstructure of the alloy, which is, in turn, controlled by the processing and heat treatment to which the alloy is subjected.

Precipitation hardening is a heat treatment that relies on changes in an alloy's solid solubility with temperature to produce fine particles of an impurity phase, which impede the movement of dislocations or defects in the alloy's crystal lattice. Since dislocations are often the dominant carriers of plasticity (deformations of an alloy under stress), this serves to harden the alloy. In precipitation-hardened nickel base alloys, there are two principal strengthening phases: namely gamma prime (v1) phase precipitates and gamma double prime (γM) phase precipitates. Both the gamma prime and gamma double prime phase are stoichiometric, nickel-rich intermetallic compounds. However, the gamma prime phase typically comprises aluminum and titanium as the major alloying elements, i.e., Ni3(Al, Ti); while the gamma double prime phase contains primarily niobium, i.e., Ni3Nb.

The precipitation hardening process for a nickel base alloy generally involves solution treating the alloy by heating it at a temperature sufficient to dissolve substantially all of the gamma prime phase and gamma double prime phase precipitates that exist in the alloy (i.e. at a temperature near, at, or above the solvus temperature of the precipitates), cooling the alloy from the solution treating temperature, and subsequently aging the alloy in one or more aging steps. Aging is conducted at temperatures below the solvus temperature of the gamma precipitates in order to permit the desired precipitates to develop in a controlled manner.

For example, the recommended heat treatment for alloy Alvac 718Plus™, (a nickel base alloy developed at ATI Allvac an Allegheny Technologies Company, Monroe, US) involves solution treating the alloy at a temperature of 954° C. for one hour, water cooling the alloy and aging the alloy in a two-step aging process. The first aging step involves heating the alloy at a first aging temperature of 788° C. for 8 hours. The alloy is then air cooled to a second aging temperature of 704° C. and aged at a second aging temperature for 8 hours. The alloy is then air cooled to room/ambient temperature.

Alvac 718Plus™ has mechanical properties that are better than the mechanical properties of alloy 718 (a nickel base alloy comprising chromium and iron, which is strengthened by niobium and/or aluminium and/or titanium) and that are comparable to the mechanical properties of Waspaloy® at temperatures up to 704° C. The improved high temperature mechanical properties of Alvac 718Plus™ are due to the high fraction and high stability of the main strengthening gamma prime phase in comparison to the gamma double prime phase in alloy 718. The high amount of aluminium and titanium in Alvac 718Plus™ namely increases the thermal stability of the alloy and the high amount of niobium increases the strengthening effect of the gamma prime phase significantly and makes its precipitation much more sluggish which will consequently enhance the hot workability and weldability of the alloy.

US patent application publication no. 2005/0072500 concerns methods of heat treating nickel base alloys, and in particular 718-type nickel base alloys, to develop a desired microstructure that can impart thermally stable mechanical properties. This document discloses that the precipitation of a controlled amount of delta phase precipitates can strengthen a nickel base alloy's grain boundaries. Delta phase precipitates have the same composition as gamma double prime phase precipitates (i.e., Ni3Nb) and are formed at temperatures higher than 649° C. in 718-type alloys, at which temperature the gamma double prime phase becomes unstable and transforms into the more stable 5 phase (or "delta phase"), The document also discloses that the precipitation of a controlled amount of delta phase precipitates contributes to reduced notch sensitivity (whereby notch sensitivity is a measure of the reduction in strength of a metal caused by the presence of a stress concentrator, for example .a surface inhomogeneity such as a notch, thread, hole, sudden change in section, crack, or scratch) and improved stress rupture life and ductility in the alloy at elevated temperatures. For these reasons, US patent application publication no. 2005/0072500 states that it is advantageous to retain delta phase precipitates in a nickel base alloy.

It is desirable to provide a method for heat treating a nickel base alloy.

A method according to an aspect of the present invention comprises the steps of; a) heating a nickel base alloy to at least its delta (δ) phase solvus temperature, and lower than its incipient melting temperature for a predetermined time sufficient to dissolve substantially all of the nickel base alloy's delta (δ) phase, and b) slow cooling the nickel base alloy to a temperature below the gamma prime (Y) precipitation temperature at a rate sufficient to precipitate the alloy's chromium carbide and gamma prime (γ1) in a serrated grain boundary. Such a method has been found to improve the creep resistance and/or the crack propagation resistance of a nickel base alloy.

The expression "substantially all" means that the microstructure of the nickel base alloy will exhibit at least one serrated grain boundary, or a plurality or majority of serrated grain boundaries, after it has been subjected to a method according to the present invention.

As regards the expression "for a predetermined time," it will be appreciated by those skilled in the art that the exact treatment time required to dissolve substantially all of the delta phase will depend on several factors, including, but not limited to the size of the work piece comprising nickel base alloy that is being treated. The bigger the work piece, the longer the holding time required to achieve the desired result will be.

Conventional high temperature heat treatment methods, such as the heat treatment recommended for Allvac 718Plus™, in which an alloy is heated above the gamma prime solvus temperature, result in the formation of planer grain boundaries. Serrated boundaries can be formed by slow cooling a nickel base alloy through its gamma prime precipitation range at the rate specified in step b) of the method according to the present invention. Serrations develop when the gamma prime phase precipitates heterogeneously in the form of rod-shaped particles on migrating grain boundaries and allows unpinned grain boundary segments to fill the space between them. Without wishing to be bound by any particular theory, these serrations are believed to impede grain-boundary sliding and to force deformation to occur more uniformly through grain interiors and grain-boundary regions. The initiation of cracks due to localized grain-boundary deformation is therefore inhibited. These serrations are also believed to impede crack propagation along the grain boundaries.

In other words, the method according to the present invention strengthens a nickel base alloy's grain boundaries by "locking" or "pinning" the grain boundaries in place, which results in the creation of a nickel base alloy that exhibits significantly improved creep properties such as improved creep resistance and/or crack propagation.

Experiments were performed to compare the notch sensitivity of nickel base alloys that had been subjected to the method according to the present invention with the notch sensitivity of commercially available nickel base alloys that had been heat treated in accordance with manufacturers' recommendations by conducting Time-for-Rupture Notch Tension Tests (in accordance with the American Society for Testing and Materials' ASTM Standard E292). These tests involved the determination of the time for rupture of notched nickel base alloy specimens under conditions of constant load and temperature.

The notch sensitivity of nickel base alloys that had been subjected to the method according to the present invention was found to be much lower than the notch sensitivity of commercially available nickel base alloys, meaning that the method according to the present invention results in the production of more ductile nickel base alloys.

According to an embodiment of the invention, in step b) the nickel base alloy is cooled at a rate of 1.0° C. per minute or less, 0.7° C. per minute or less, or 0.5° C. per minute or less, and at a rate 0.05° C. per minute or higher, or 0.1° C. per minute or higher.

According to an embodiment of the invention the method comprises the step of c) heating the nickel based alloy at a first aging temperature below the solvus temperatures for the gamma prime phase and the gamma double prime phase to form primary precipitates of the gamma prime and gamma double prime phase and, optionally, the method comprises the step of d) heating the alloy at a second aging temperature below the solvus temperatures for the gamma prime phase and the gamma double prime phase to form finer secondary precipitates of the gamma prime and gamma double prime phase (since the presence of gamma prime and gamma double prime phase precipitates having a distribution of sizes, as opposed to a uniform precipitate size is believed to improve the mechanical properties of the nickel base alloy).

According to an embodiment of the invention the method according to the present invention may be carried out on a nickel base alloy that has the following composition in weight-%: Cr 17-21, C 0.01-0.05, Mn max 0.35, Si max 0.35, P 0.004-0.020, S max 0.0025, Mo 02.5-3.1, Nb 5.2-5.8, Ti 0.5-1, Al 1.2-1.7, Co 8-10, W 0.8-1.4, B 0.003- 0.008, Cu max 0.3, Fe 8-10, and balance Ni and normally occurring impurities.

According to another embodiment of the invention the method according to the present invention may be carried out on a 718-type nickel base alloy, such as Allvac 718Plus™.

When the nickel base alloy is Allvac 718Plus™ or when it has the composition specified above, the nickel base alloy is preferably heated to a temperature that is sufficient to dissolve substantially all of the nickel base alloy's delta (δ) phase but that does not exceed a temperature that will promote grain growth, namely to a temperature of 1040° C. ±14° C. According to an embodiment of the invention the nickel base alloy is held at that temperature until substantially all of the nickel base alloy's delta (δ) phase has been dissolved, preferably for 0.5 hour in step a). According to another embodiment of the invention the alloy is then slow cooled from 1040° C. to a temperature of 650° C.±14° C. or lower in step b) since all of the alloy's chromium carbide and gamma prime (Y) should theoretically have precipitated in a serrated grain boundary once the alloy has been cooled to 650° C. According to a further embodiment of the invention the nickel base alloy may subsequently be aged by heating the nickel base alloy to a first aging temperature of 788° C.±14° C. in step c). According to an embodiment of the invention the nickel base alloy is held at that temperature for about 8 hours in step c) i.e. for 8 hours or more. According to another embodiment of the invention the nickel base alloy is then cooled from 788° C.±14° C. to a second aging temperature of 704° C.±14° C. in step d). According to a further embodiment of the invention the nickel base alloy is held at that temperature for about 8 hours in step d) i.e. for 8 hours or more.

It should be noted that the first and second aging temperatures and holding times cited above in steps c) and d) are specific to Allvac 718Plus™ or a nickel base alloy that has the composition specified above. When heat treating a different nickel base alloy, the aging temperatures and holding times recommended by manufacturers should be used in steps c) and d).

The method according to the present invention may be used in conjunction with of a variety of nickel base alloy compositions such as any nickel base alloy that is strengthened by gamma prime and gamma double prime.

The present invention also concerns a nickel base alloy at least part, or the whole, of which has been subjected to a method according to any of the embodiments of the invention. The nickel base alloy may be a cast or wrought nickel base alloy in the form a billet, coil, sheet, bar, ingot, rod, tube or any other desired form.

According to an embodiment of the invention the microstructure of the nickel base alloy exhibits chromium carbide and gamma prime (Y) precipitated in a serrated grain boundary.

The present invention also concerns a component comprising a nickel base alloy according to any of the embodiments of the invention. The component may for example be a turbine or compressor disc, blade, rotor, case, shaft, spacer, seal or fastener or any other component used in any application in which it may be subjected to operating conditions involving corrosive environments, high temperatures and/or high stresses.

The inventive nickel base alloy and component are intended for use particularly, but not exclusively in aircraft and industrial gas turbines, steam turbine power plants, submarines, rocket engines, turbochargers and valves in reciprocating engines, heat treating equipment, chemical processing equipment, gasification and liquefaction systems, in marine applications and components in pulp and paper mills.

The present invention further concerns an aircraft engine comprising a component according to any of the embodiments of the invention.

BRIEF DESCRIPTION OF THE DRAWINGS

The present invention will hereinafter be further explained by means of non-limiting examples with reference to the appended figures where.

DETAILED DESCRIPTION

Figure 1:
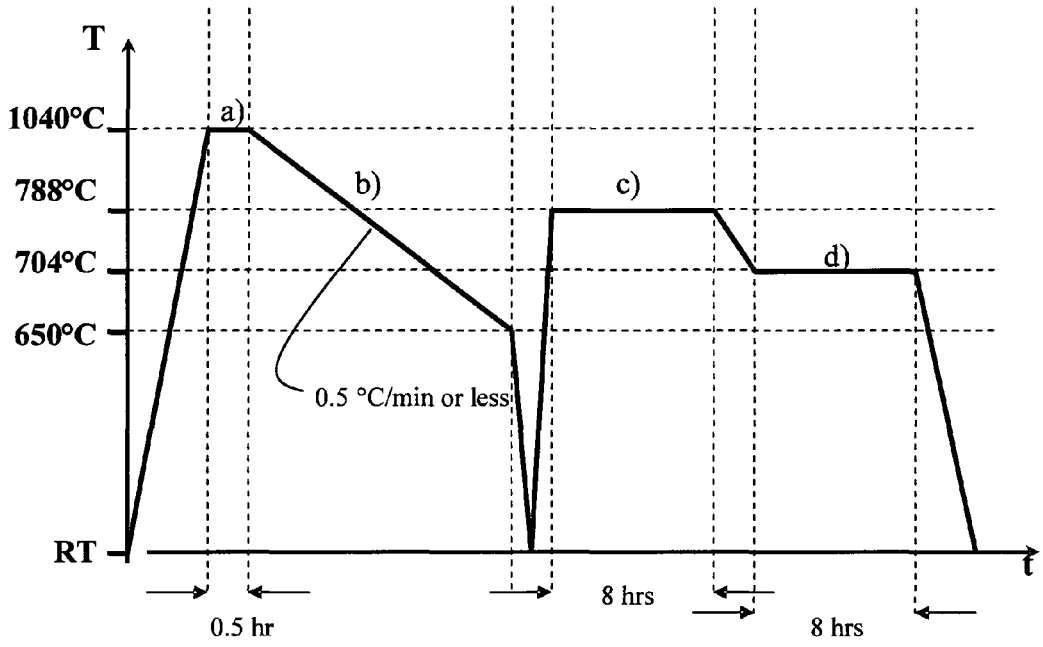
FIG. 1 schematically shows a temperature/time diagram depicting a method according to an embodiment of the invention.

FIG. 1 schematically shows a method for heat treating at least part of commercially available Allvac 718Plus™ (that has an incipient melting temperature of 1260° C.). The method comprises the steps of;

a) heating at least one part of the alloy to its delta (δ) phase solvus temperature, 1040° C., and holding it at that held at that temperature for 0.5 hour to dissolve substantially all of the delta (δ) phase present in the alloy's as-received microstructure , b) slow cooling the at least one part of the alloy from the solution temperature of step a) to 650° C. at a rate of 0.5° C. per minute or less, without interruption, to precipitate the alloy's chromium carbide and gamma prime (γ1) in a serrated grain boundary (step b), the alloy may then be cooled to room temperature, c) heating the at least one part of the alloy to a temperature of 788° C. and holding it at that temperature for about 8 hours, and d) cooling the at least one part of the nickel base alloy from 788° C. to 704° C. and holding it at that temperature for about 8 hours.

The at one least part of the nickel base alloy that has been subjected to such a method will have a microstructure that is entirely free, or at least substantially free of delta phase, wherein gamma prime phase precipitates are the predominant strengthening precipitates. More particularly, such a method will produce a nickel base alloy that has improved creep resistance and/or crack propagation resistance.

Figure 2:
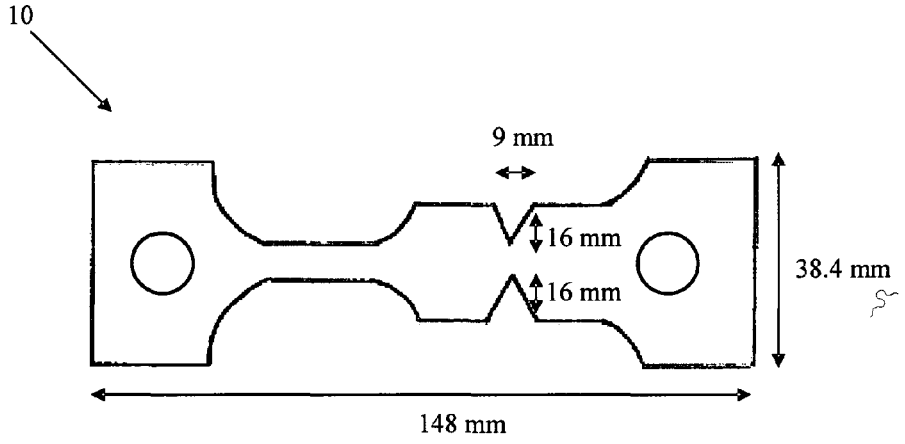
FIG. 2 shows the test sample geometry used for testing the notch sensitivity of a nickel base alloy.

FIG. 2 shows test sample 10 geometry that was used to conduct Time-for-Rupture Notch Tension Tests to compare the notch sensitivity of nickel base alloys that had been subjected to the method according to the present invention with the notch sensitivity of commercially available nickel base alloys that had been heat treated in accordance with manufacturer's recommendations.

Test samples 10 were manufactured from a 3 mm thick sheet of Allvac 718Plus™ using electric discharge wire (EDW) machining and tested in accordance with the ASTM 292 Standard. Test samples 10 were tested in a thermally insulated induction furnace in an air environment at a temperature of 704° C. using a load of 690 MPa. To avoid temperature fluctuations while the tests were taking place, all the tests began by stabilising the temperature. Six thermocouples were used for controlling the temperature of the induction furnace in which the test samples 10 were placed for testing. Three thermocouples were attached to the test sample 10, one at the centre of the test sample and one at each end thereof, and three thermocouples were evenly spaced and embedded in the door of the induction furnace. The thermocouples were connected to a temperature regulator and to a computer which logged the temperature and time.

It was found that Allvac 718Plus™ that had been subjected to the method shown schematically in FIG. 1 ruptured after 25 minutes whereas commercially available Allvac 718Plus™ that had been subjected to the recommended heat treatment (as outlined in the Background of the Invention above) ruptured after 13 minutes.

Figure 3:
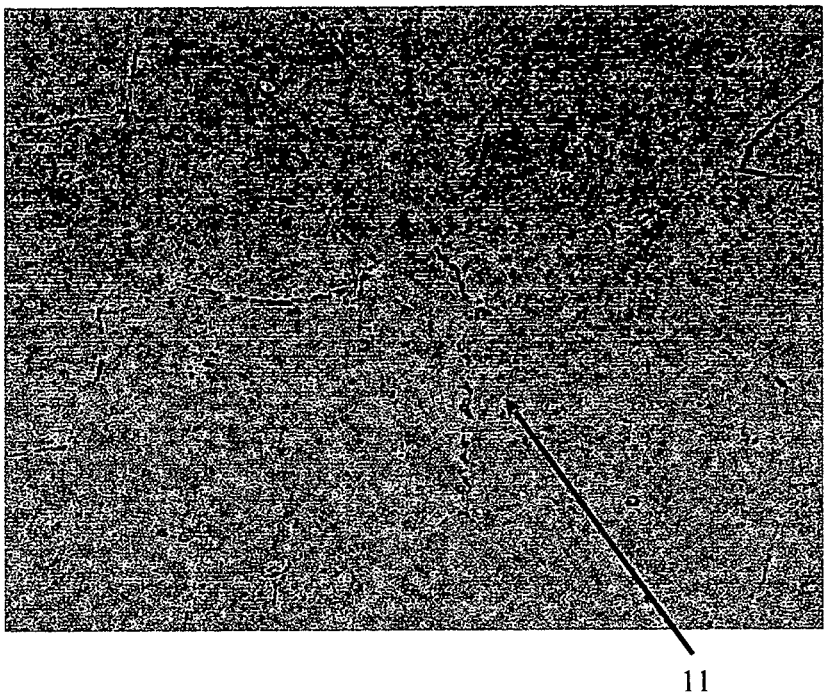
FIG. 3 shows a micrograph of the microstructure of a nickel base alloy after it has been subjected to a method according to an embodiment of the invention, and a schematic representation of the grain boundaries shown in the micrograph, and FIG. 4 schematically shows an aero-engine comprising components according to an embodiment of the invention.
Figure 3:
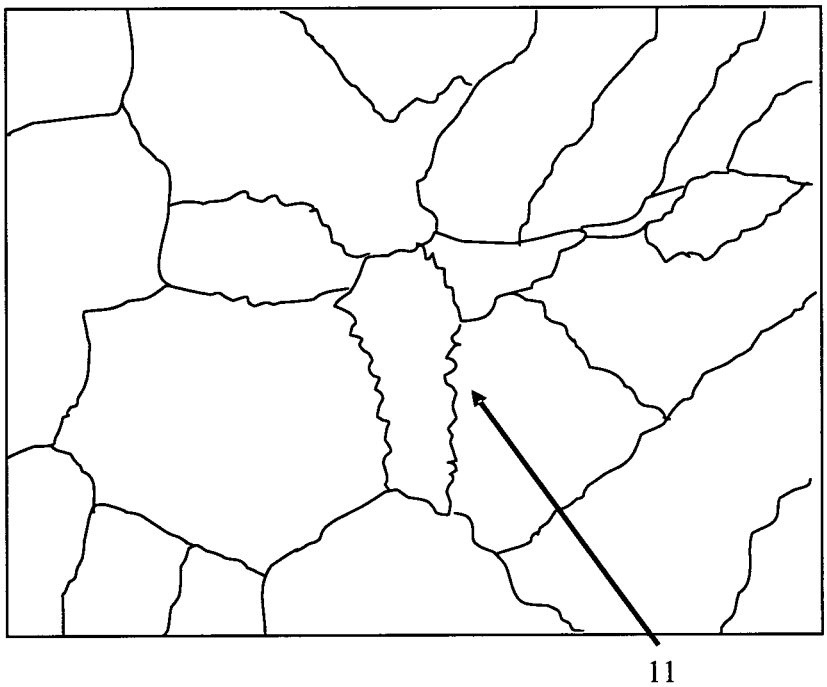

This significant improvement in creep properties is believed to be due to the serrated grain boundary that is formed in Allvac 718Plus™ when it has been subjected to a method according to the present invention. FIG. 3 shows a micrograph showing the microstructure of a nickel base alloy after it has been subjected to a method according to an embodiment of the invention and a schematic representation of the grain boundaries shown in the micrograph. The microstructure shown in FIG. 3 exhibits chromium carbide and gamma prime (Y) precipitated in serrated grain boundaries that resemble the toothed edge of a saw, the presence of serrated grain boundaries indicating that the Allvac 718Plus™ has been subjected to a method according to the present invention. The arrow in FIG. 3 indicates one of the most clearly visible serrated grain boundaries 11 in the micrograph.

Figure 4:
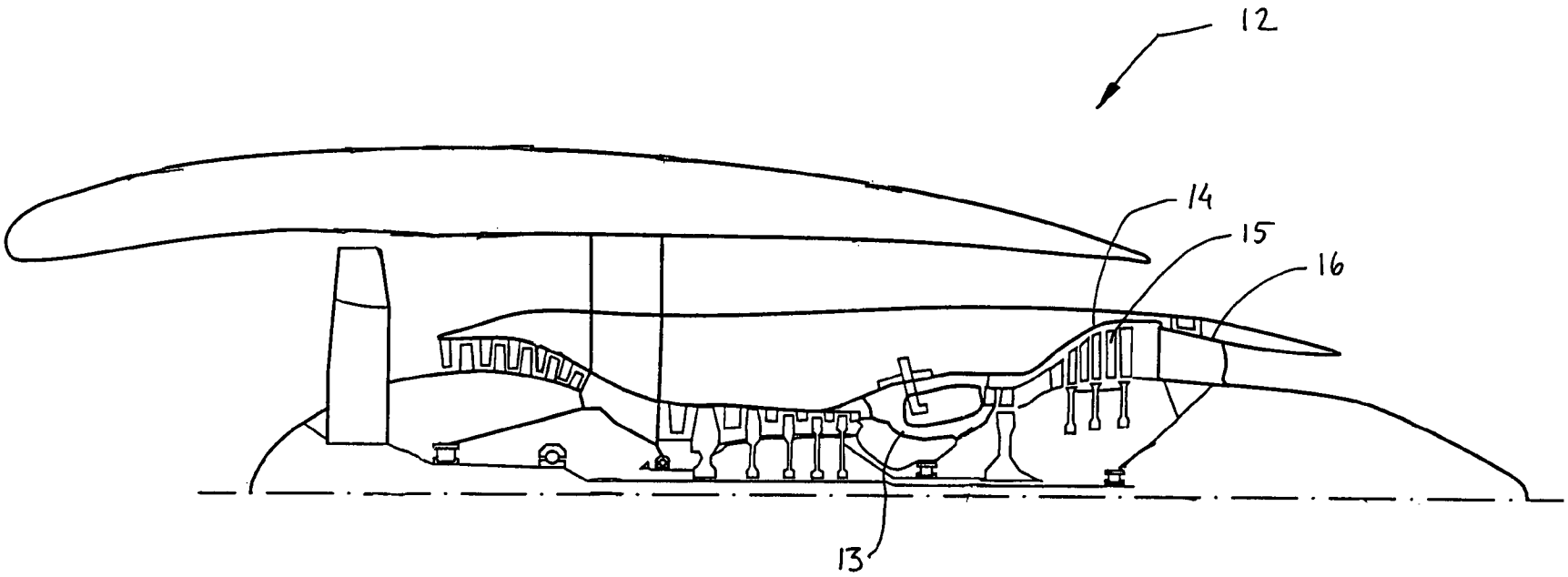

FIG. 4 schematically shows a cross section through an aero-engine 12 which comprises a plurality of components, namely a diffuser case 13, a low pressure turbine (LPT) case 14, vanes 15 and a turbine exhaust case 16, comprising a nickel base alloy according to an embodiment of the invention. It should be noted that an entire component made of a nickel base alloy need not necessarily be subjected to a method according to an embodiment of the invention, it may be sufficient to heat treat one or more parts of the component that is/are subjected to the highest temperatures and/or highest stresses 15 when the aero engine is in use.

Further modifications of the invention within the scope of the claims will be apparent to a skilled person.

The invention claimed is:

1. Method for heat treating a nickel base alloy, comprising the steps of:

a) heating a nickel base alloy to at least its delta (δ) phase solvus temperature, and lower than its incipient melting temperature for a predetermined time sufficient to dissolve substantially all of the nickel base alloy's delta (δ) phase, and b) cooling the nickel base alloy to a temperature below the gamma prime (γ1) precipitation temperature at a rate sufficient to precipitate the alloy's chromium carbide and gamma prime (γ1) in a serrated grain boundary.

wherein the nickel base alloy has the following composition in weight- %:

Cr 17-21
C 0.01-0.05
Mn max 0.35
Si max 0.35
P 0.004-0.020
S max 0.0025
Mo 2.5-3.1
Nb 5.2-5.8
Ti 0.5-1
Al 1.2-1.7
Co 8-10
W 0.8-1.4
B 0.003-0.008
Cu max 0.3
Fe 8-10
balance Ni and normally occurring impurities.

2. Method according to claim 1, wherein the nickel base alloy is cooled at a rate of 1.0° C. per minute or less in step b).

3. Method according to claim 1, wherein the nickel base alloy is cooled at a rate of 0.7° C. per minute or less in step b).

4. Method according to claim 1 wherein the nickel base alloy is cooled at a rate of 0.5° C. per minute or less in step b).

5. Method according to claim 1, wherein the nickel base alloy is cooled at a rate of 0.05° C. per minute or higher in step b).

6. Method according to claim 1, wherein the nickel base alloy is cooled at a rate of 0.1° C. per minute or higher in step b).

7. Method according to claim 1, comprising the step of heating the nickel base alloy to a temperature of 1040° C.±14° C. in step a).

8. A method according to claim 1, comprising the step of holding the nickel base alloy at the heated temperature for 0.4to 0.8hour in step a).

9. Method according to claim 1 wherein the method further comprises the step of:

heating the alloy at an aging temperature below the solvus temperatures for the gamma prime phase and the gamma double prime phase to form secondary precipitates of the gamma prime and gamma double prime phase.

10. A method according to claim 9, comprising the step of cooling the nickel base alloy to a temperature of 704° C. ±14° C. in the step of heating the alloy at the aging temperature.

11. A method according to claim 9, comprising the step of holding the nickel base alloy at the first aging temperature for about 8 hours in the step of heating the alloy at the aging temperature.

12. Method for heat treating a nickel base alloy, comprising the steps of:

a) heating a nickel base alloy to at least its delta (δ) phase solvus temperature, and lower than its incipient melting temperature for a predetermined time sufficient to dissolve substantially all of the nickel base alloy's delta (δ) phase, and b) cooling the nickel base alloy to a temperature below the gamma prime (γ1) precipitation temperature at a rate sufficient to precipitate the alloy's chromium carbide and gamma prime (γ1) in a serrated grain boundary c) heating the nickel based alloy at a first aging temperature below the solvus temperatures for the gamma prime phase and the gamma double prime phase to form primary precipitates of the gamma prime and gamma double prime phase.

13. A method according to claim 12, comprising the step of heating the nickel base alloy to a temperature of 788° C.±14° C. in step c).

14. A method according to claim 12, comprising the step of holding the nickel base alloy at the first aging temperature for about 8 hours in step c).

15. Method for heat treating a nickel base alloy, comprising:

heating a nickel base alloy to at least its delta (δ) phase solvus temperature, and lower than its incipient melting temperature for a predetermined time sufficient to dissolve substantially all of the nickel base alloy's delta (δ) phase, and cooling the nickel base alloy to a temperature below the gamma prime (γ1) precipitation temperature at a rate sufficient to precipitate the alloy's chromium carbide and gamma prime (γ1) in a serrated grain boundary, and cooling the nickel base alloy to a temperature of 650° C. ±14° C. in step b).

* * * * *